United States Patent [19]

Paoletti

[11] Patent Number: 4,995,610

[45] Date of Patent: Feb. 26, 1991

[54] ELECTRIC BOXING GAME

[76] Inventor: George J. Paoletti, 78 Melrose St., Arlington, Mass. 02174

[21] Appl. No.: 352,260

[22] Filed: May 16, 1989

[51] Int. Cl.[5] ..... A63F 13/06

[52] U.S. Cl. ..... 273/85 F; 446/335

[58] Field of Search ..... 273/85 G, 85 R, 85 E, 273/85 F, 1 E; 434/408; 40/411, 414, 427; 446/335, 333, 334, 484, 336

[56] References Cited

U.S. PATENT DOCUMENTS

| | | | |
|---|---|---|---|
| 1,596,921 | 8/1926 | Childs | 40/415 |
| 3,055,113 | 10/1962 | Grandjean | 434/408 |
| 3,235,259 | 2/1966 | Glass et al. | 273/85 F |
| 3,801,100 | 4/1974 | Lebrun | 273/85 F |
| 3,856,304 | 12/1974 | Matsumoto et al. | 273/85 F |
| 3,898,438 | 8/1975 | Nater et al. | 40/411 |
| 4,588,187 | 5/1986 | Dell | 273/148 B |
| 4,591,158 | 5/1986 | Samson et al. | 446/336 |

FOREIGN PATENT DOCUMENTS

| | | | |
|---|---|---|---|
| 772876 | 12/1967 | Canada | 273/85 F |
| 0745531 | 7/1980 | U.S.S.R. | 273/85 F |
| 2040708 | 9/1980 | United Kingdom | 446/335 |

*Primary Examiner*—Edward M. Coven
*Assistant Examiner*—Jessica J. Harrison
*Attorney, Agent, or Firm*—George W. Crowley

[57] ABSTRACT

In a boxing game where two opposed doll boxers are movably mounted on a support surface, each boxer having swingable arms and a punch-received indicator, an improved game is provided, wherein electric and/or computer control means operate at least one boxer as to body movement and arm movements against the other boxer. In one embodiment of the invention, two players compete with opposing boxers by indirect electric controls e.g. two joy sticks. In a second embodiment of the invention, a player with direct manual control of his boxer competes against a boxer guided by a computer, which senses the opposing boxers body moves and punches and directs its boxer in counter body moves and punches. In the third embodiment a player indirectly guides his boxer by a joy stick, mouse, or other electric control against a computer, which senses the moves of e.g. the joy stick and arm swing buttons and guides its boxer in counter body moves and punches.

20 Claims, 7 Drawing Sheets

ELECTRIC BOXING GAME

BACKGROUND OF THE INVENTION

1. Field of the Invention

This invention relates to a boxing game, particularly a mechanical boxing game with electrical components.

2. The Prior Art

Mechanical boxing games, i.e. those in which toy or doll boxers guided by the hands of opposing players, swing mechanical punches at each other to score points, knockdowns and the like are known. See Glass U.S. Pat. No. 3,235,259, et al (1966) and Matsumoto U.S. Pat. No. 3,856,304, et al (1974) for examples of these manually powered mechanical toy boxing games. These games provide significant range of motion and competitiveness. However, the players can push the dolls and the game platform too hard, resulting in wear and tear and premature breakage of the components thereof in the heat of battle. And of course, such manually powered game requires two players for two boxers.

There is, therefore, a need and market for a boxing game which overcomes the above prior art shortcomings.

There has now been discovered a mechanical boxing game in which at least one of the player's manual controls is structurally separated from the game surface and the two boxers of the Boxing Game for increased durability thereof. In one embodiment both boxers are operated indirectly by manual electric controls. In another embodiment a player's boxer competes against a boxer controlled by a preprogrammed computer, so that a single player can challenge a computer.

SUMMARY

Broadly the present invention provides in a boxing game wherein two opposed doll boxers are movably mounted on a support surface, each boxer having swingable arms and a punch-received indicator, the improvement comprising electric control means for indirectly operating at least one boxer as to body movement and arm movement against the other boxer.

In one embodiment, tWo boxers are activated by manually operated electric control means.

In another embodiment, a boxer operated by direct manual control competes against a boxer operated by a computer.

In another embodiment, a boxer activated by a manually operated electric control competes against a boxer operated by a computer.

BRIEF DESCRIPTION OF THE DRAWINGS

The invention will become more apparent from the following detailed specification and drawings in which.

DESCRIPTION OF PREFERRED EMBODIMENT

Figure 1:
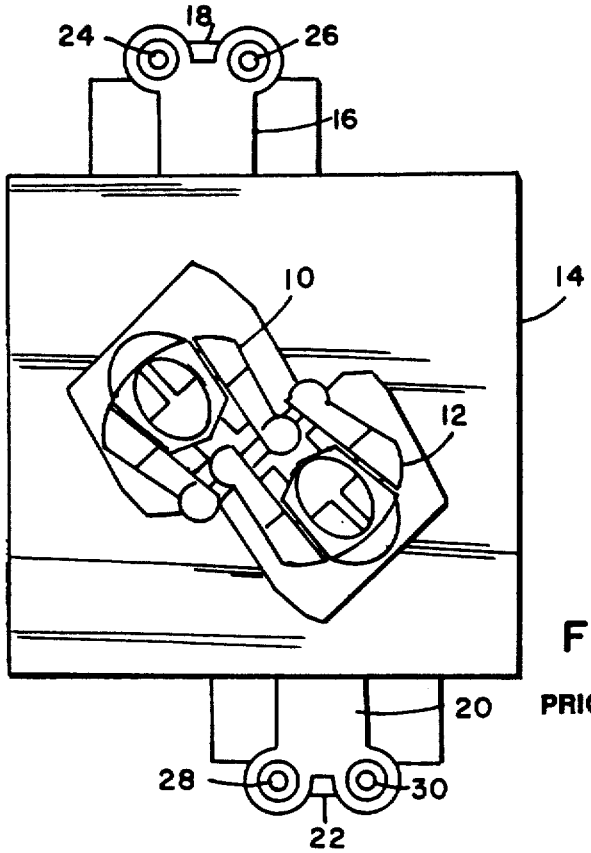
FIG. 1 PRIOR ART
FIG. 1 is a plan view of a prior art manually operated boxing game.

Referring in more detail to the drawings, in the prior art direct manual control, mechanical boxing game, a pair of doll boxers 10 and 12 are positioned in a boxing ring 14. Boxer 10 connects by stem 16 to handle 18, while boxer 12 connects by stem 20 to handle 22, as shown in FIG. 1. Handle 18 has a pair of push buttons 24 and 26, which activate right and left arms of the boxer 10, while handle 22 has a pair of push buttons 28 and 30, which activate the left and right arms respectively of boxer 12, as shown in FIG. 1.

In operation, a player will grasp the two pedestals of buttons 28 and 30 of handle 22 with both hands with thumbs poised over such push buttons 28 and 30, to push boxer 12 into position and press the buttons 28 and 30, causing the boxer arms to swing up and hit the opposing boxer 10. Similarly another player will grasp handle 18 by the pedestals of push buttons 24 and 26 to maneuver boxer 10 into position and press the push buttons 24 and 26, to activate the left and right and left arms of the boxer 10 so as to strike the opposing boxer 12 as indicated in FIG. 1.

The above prior art game is a direct manual control nonelectric, noncomputerized boxing game.

Figure 2:
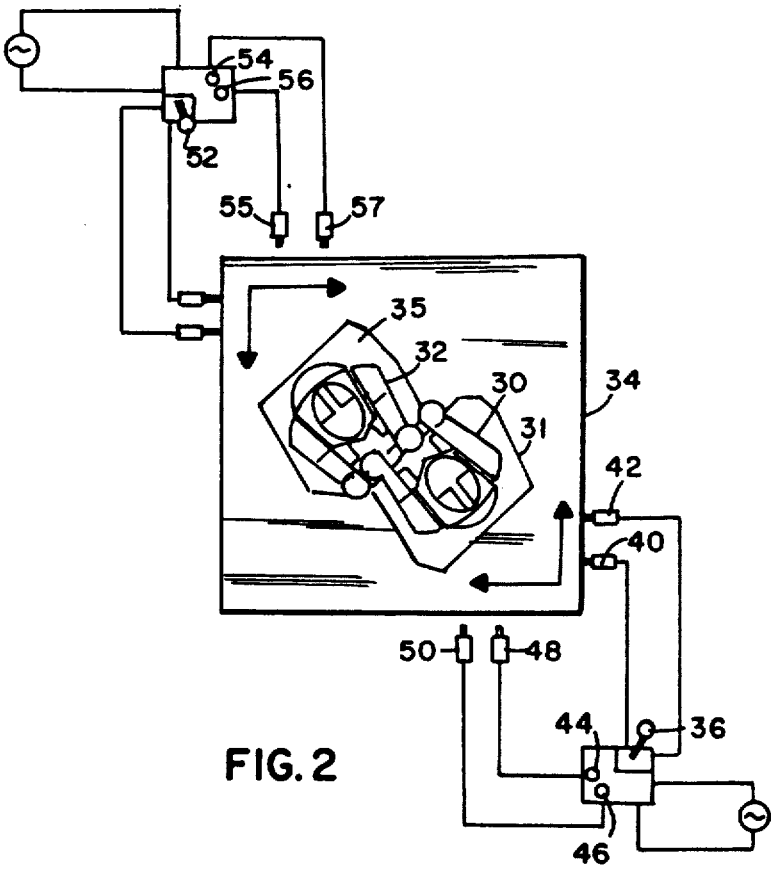
FIG. 2 is a schematic plan view of an electrically operated mechanical boxing game embodying the present invention.

The first embodiment of the present invention is shown in FIG. 2 in which boxers 32 and 30 are maneuvered as before but by indirect electric controls. For example boxer 30 is controlled by joy stick 36 connected to x-axis motor 42 and y-axis motor 40 to move the boxer 30 on x and y axes respectively with corresponding movements of the joy stick 36, as indicated in FIG. 2. A pair of push buttons 44 and 46, operate solenoids 48 and 50, respectively to swing the left and right arms of the boxer 30 into striking range of the head of boxer 32, as shown in FIG. 2. The boxer 32 is similarly operated by joy stick 52 and push buttons 54 and 56, as shown in FIG. 2.

Figure 3:
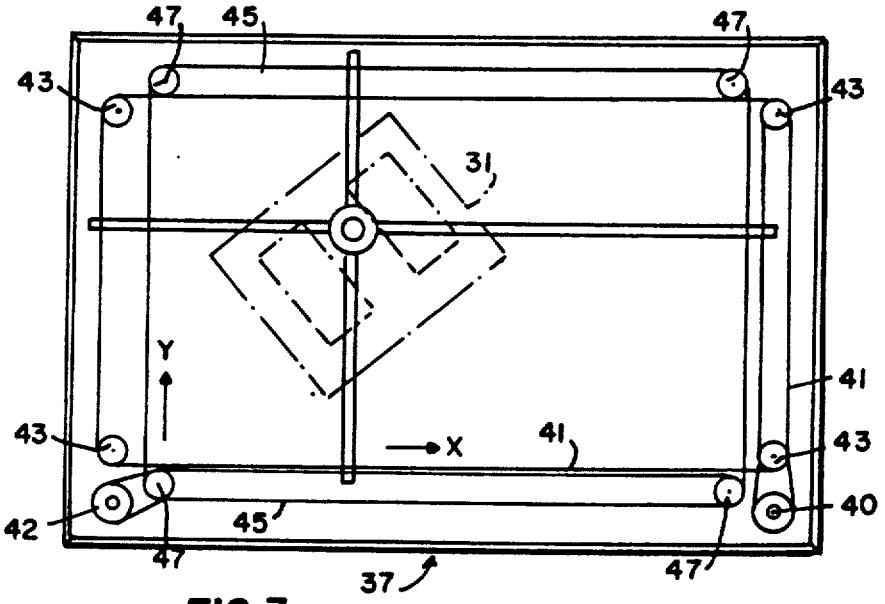
FIG. 3 is a schematic plan view of the drive system for moving the boxers in the embodiment shown in FIG. 2.
Figure 5:
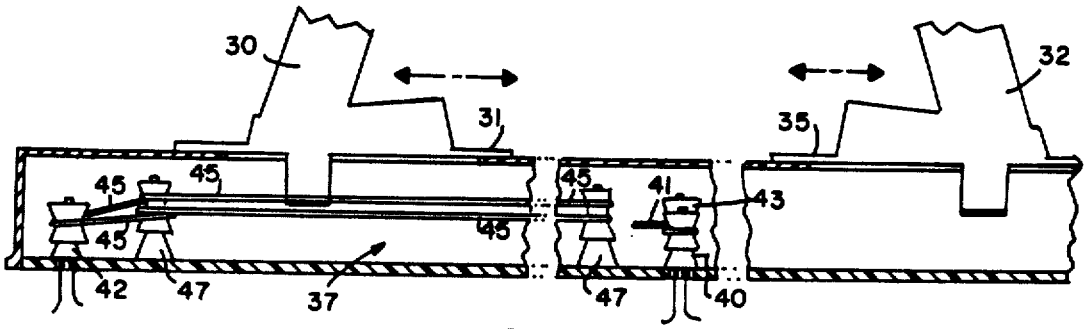
FIG. 5 is a fragmentary sectional elevation view taken on lines 5—5 of FIG. 4, looking in the direction of the arrows.

In an enlarged fragmentary view of the schematic shown in FIG. 3, y-axis motor 40 drives endless cable 41 around pulleys 43, which moves the platform 31 of the boxer 30 back and forth on the y-axis, while x-axis motor 42 drives endless cable 45 around pulleys 47, to move platform 31 back and forth on the x-axis as shown in FIGS. 3 and 5. Such x-y movement system 37 is similar to that more fully disclosed in A. Grandjean U.S. Pat. No. 3,055,113 (1962), the pertinent part of which disclosure is incorporated herein by reference. Other x-y mechanisms can also be employed within the scope of the present invention.

Figure 4:
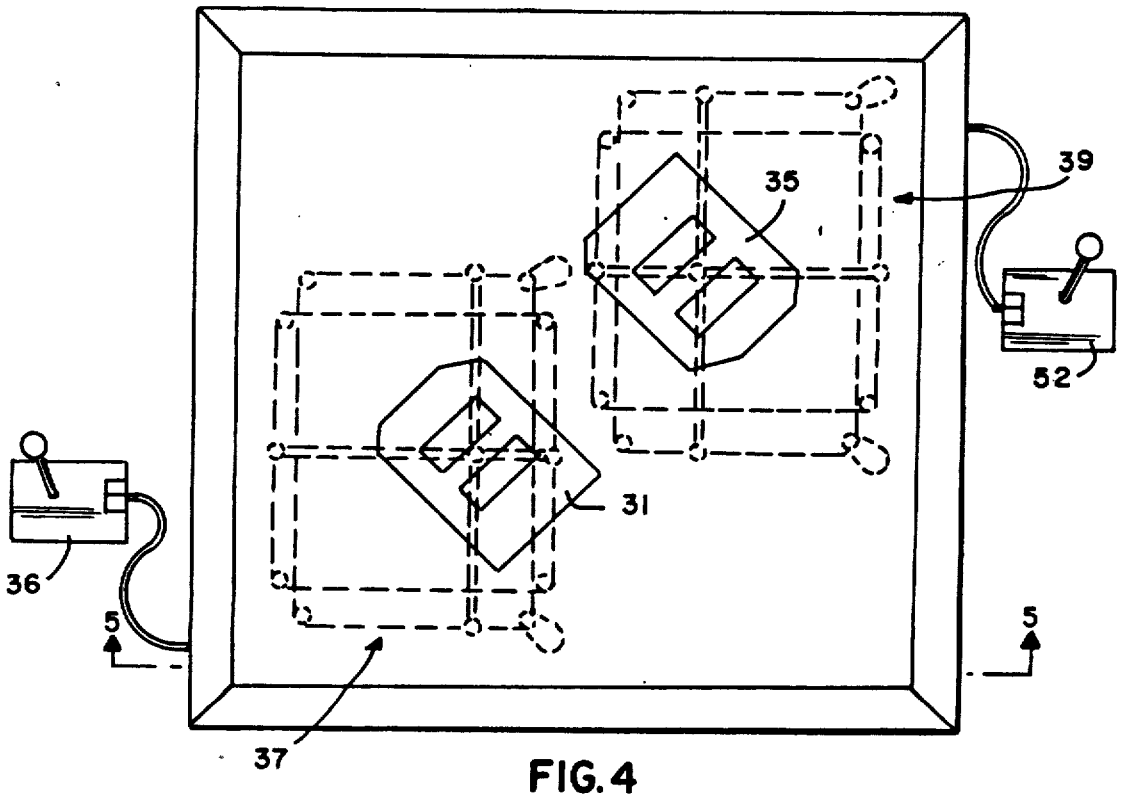
FIG. 4 is a schematic plan view showing the interrelation of the boxer's platforms in the embodiment of FIG. 2.

Relative to the invention embodiment shown in FIG. 2, boxer 30 is moved on its platform 31 by x-y movement system 37, while boxer 32 is moved on its platform 35 by x-y movement system 39, as directed by joy sticks 36 and 52, as shown in FIG. 4 and indicated in FIG. 5.

Figure 6:
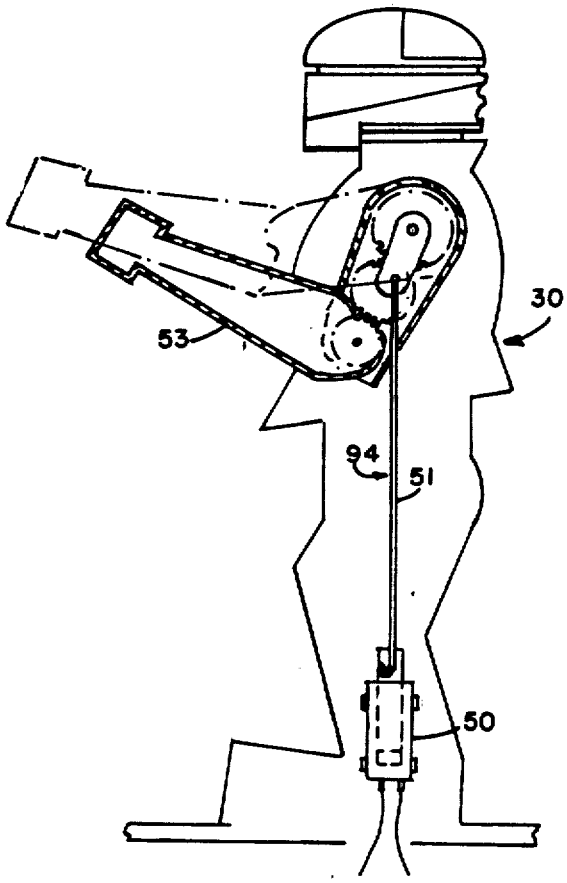
FIG. 6 is an elevation view partly in section of a component of the invention embodiment shown in FIG. 2.

As indicated in FIG. 2, push buttons 44 and 46 control arm swinging solenoids 48 and 50 of the boxer 30, while push buttons 54 and 56 control arm-swinging solenoids 55 and 57 of boxer 32. More specifically solenoid 50 reciprocates tie rod 51 and thus the attached boxer arm 53, as shown in FIG. 6.

The advantage of the invention embodiment of FIGS. 2 and 3 over the prior art embodiment of FIG. 1, is that in FIG. 1, direct physical force can push the game around and break the components thereof, whereas in the game of FIG. 2, direct physical force can only be applied to the joy stick assembly and not to the remaining game components.

Figure 7:
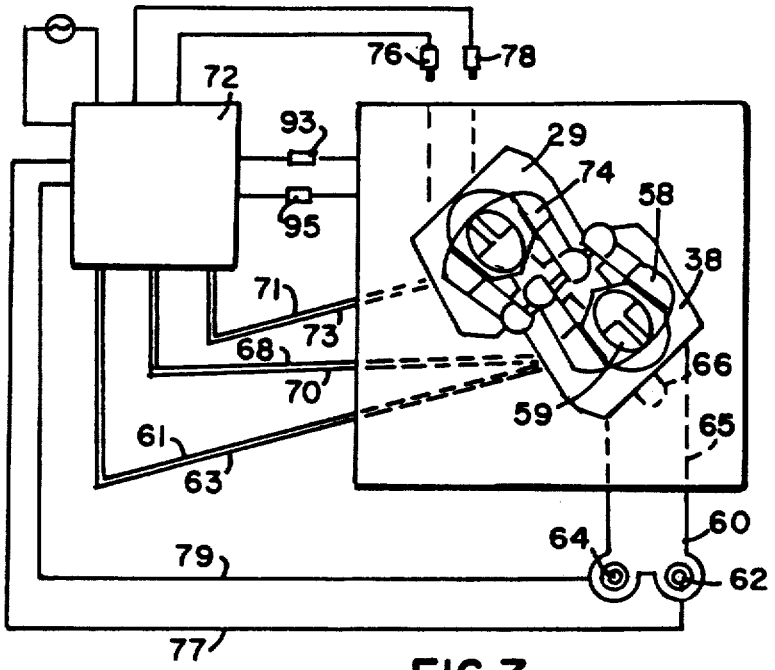
FIG. 7 is a schematic plan view of another, in part, electrically operated mechanical boxing game embodiment of the present invention.
Figure 8:
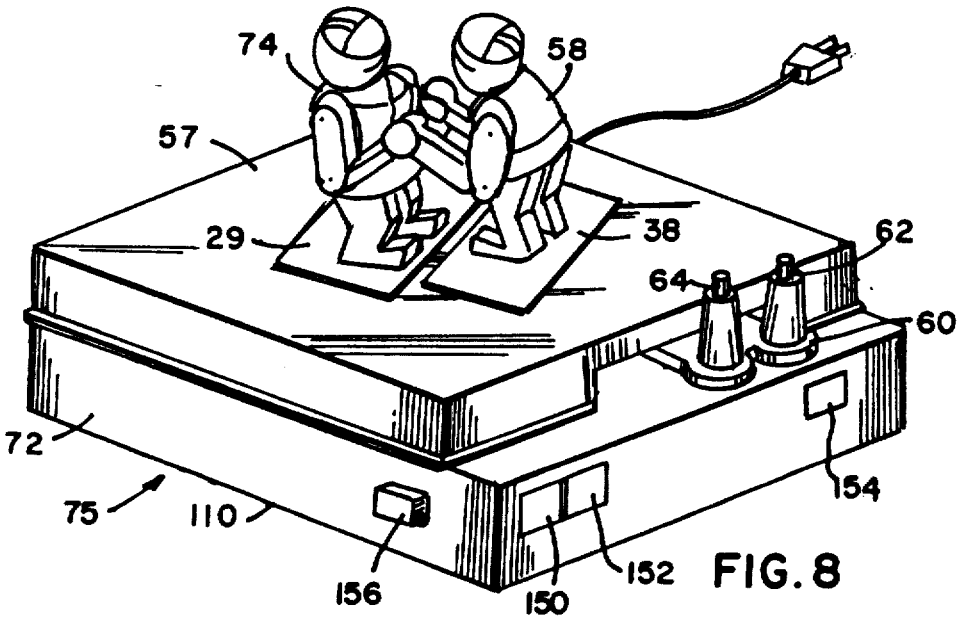
FIG. 8 is a perspective view of the boxing game embodiment of the invention shown in FIG. 7.
Figure 10:
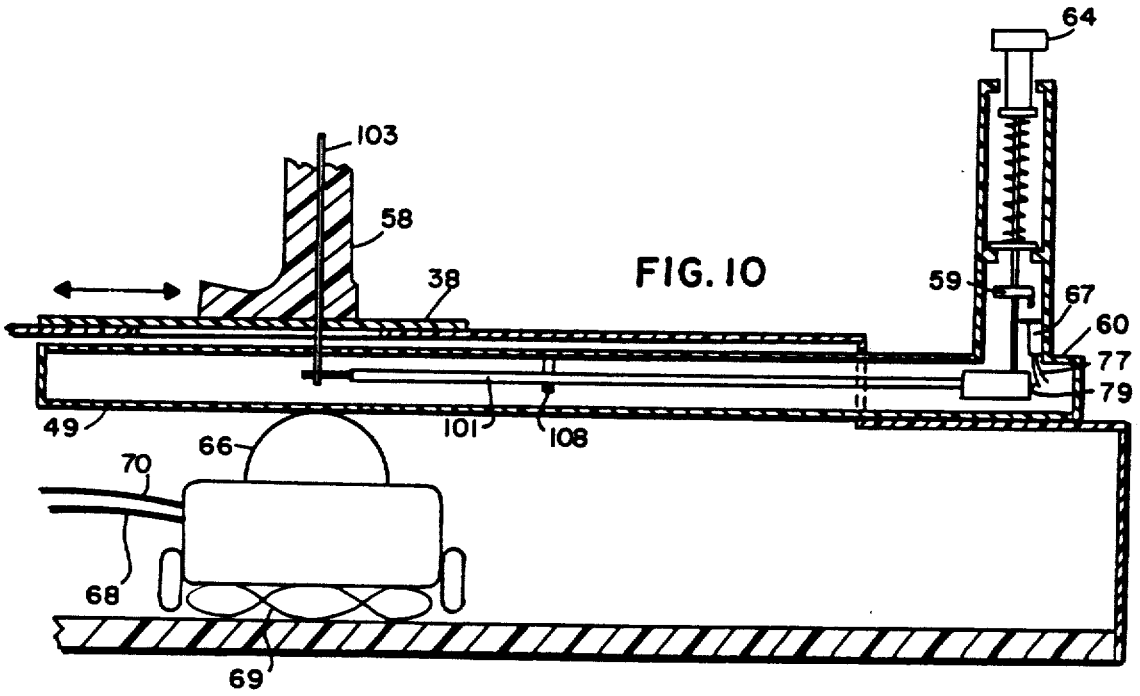
FIG. 10 is a fragmentary sectional elevation view of components of the invention shown in FIGS. 7 and 8.

In a second embodiment of the invention, per FIGS. 7 and 8, boxer 58 is directly controlled by handle 60 and push buttons 62 and 64 in the manner of the boxer 12 of FIG. 1. However a sensor(s) such as a mouse ball (or track ball) 66, supported on resilient washer 69, is mounted in contact with the bottom surface of the stem 49 of the handle 60, which sensor 66 is connected by conductors 68 and 70 to a computer 72, as shown in FIGS. 7 and 10. Also, a sensor such as limit sensor 67, is mounted to engage push button contact 59 on the downstroke of said push button and to transmit digital signals of such downstroke over conductors 77 and 79, to the computer 72 (per FIGS. 7 and 10). Such push button, by tie rod 101 on pivot 108 in the housing of the stem 49 and by tie rod 103, controls the arm swings of the boxer 58, to thus signal (e.g. by limit sensor 67) the computer of the punching arm movements of the boxer 58, so that the computer can send signals to its boxer 74, relative to counter body moves and counter-punches, as indicated in FIGS. 10 and 7. The swings of the arms of the computer's boxer 74 are powered by solenoids in the manner of e.g. solenoid 50 shown in FIG. 6.

Figure 9:
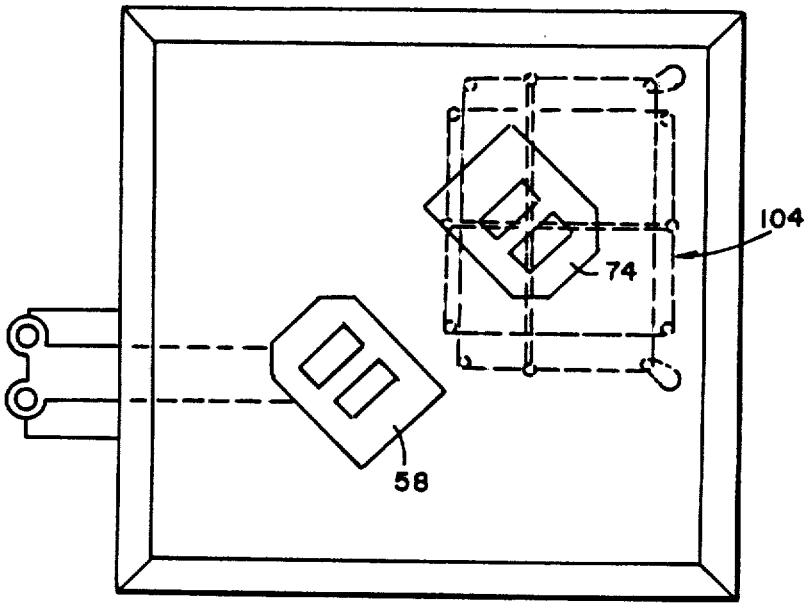
FIG. 9 is a fragmentary schematic plan view of components of the invention embodiment shown in FIGS. 7 and 8.

The computer 72 is also connected by an x-axis and a y-axis pair of motors 93 and 95 to its boxer 74, as shown in FIG. 7. That is, the boxer 74 moves on an x-y axis pulley system 104, as shown in FIG. 9, while the boxer 58 is powered manually also as indicated in FIG. 9. The computer 72 is also connected through solenoids 76 and 78 to the left and right arms of its boxer 74, as shown in FIG. 7 and indicated in FIG. 6, as noted above.

The computer, motors and wiring of the invention embodiment shown in FIG. 7, fit compactly into the base 110 of the computer housing 75 below the direct manual controls 60 of the boxer 58, as shown in perspective in FIG. 8. The top of the computer housing 75 can also serve as the boxing ring, as indicated in FIG. 8. Display windows 150, 152 and 154 can indicate points scored by boxers 74 and 58 and the round number, while push button 156 serves to start and restart the computer 72 and its boxer 74, as shown or indicated in FIG. 8.

In this way a human-controlled boxer 58 can compete against a computer controlled boxer 74, according to the invention.

In operation boxer 58 is directly controlled by a player as to body movement and arm punching as previously described with respect to FIG. 1. Movement of the boxer 58 on the ring surface 57, causes the mouse ball sensor 66 to roll and send signals via conductors 68 and 70 to the computer 72, informing the computer of the movements of the boxer 58. The computer 72, as directed by game logic, responds to the maneuvers of the boxer 58 by sending signals to its x-axis and y-axis motors 93 and 95, guiding its boxer 74 in its counter-moves against the boxer 58. The computer 72 further, upon sensing that its boxer 74 is in the right position and/or sensing the arm swings of boxer 58, initiates counter-moves and/or sends signals to its solenoids 76 and 78 activating the left and right arms of its boxer 74, to attempt to strike the head 65 of the boxer 58.

Figure 11:
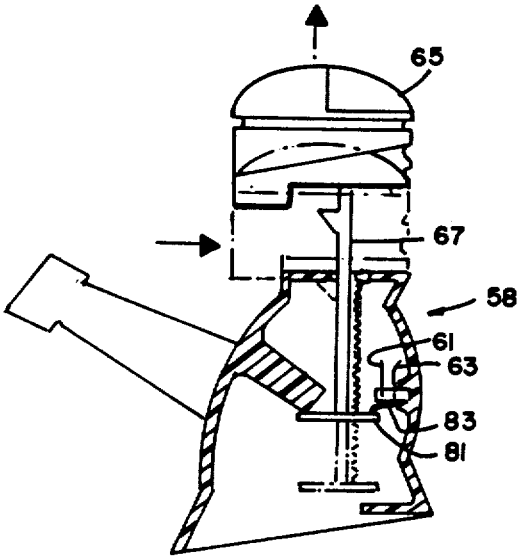
FIG. 11 is a fragmentary sectional elevation view of components of the invention embodiments shown in FIGS. 7 and 12.

When a direct hit occurs, the head 65 of the boxer 58 is knocked upwardly of the body thereof, causing the flange 81 on the neck stem 67, to contact and close switch 83, closing the circuit of conductors 61 and 63, as shown in FIG. 11, sending a signal along said conductors to the computer 72, as indicated in FIG. 7, which signals the computer to stop the operation of its boxer 74 and a point is scored for the computer. The head 65 is then manually lowered or reset into the shoulders of the boxer 58. Pushing a button on the computer 72 of FIG. 7, reactivates the computer circuitry and restarts the game with the player through his boxer 58 trying to knock the head of the computer's boxer 74 into the up position, whereupon another neck stem circuit of such boxer 74 is opened (in the manner described above with respect to boxer 58) to again signal the computer by way of conductors 71 and 73, shown in FIG. 7, to score a point for the player's boxer and cease its operation until the head of the boxer 74 is lowered or reset into the shoulders thereof and the game can thus continue.

Figure 12:
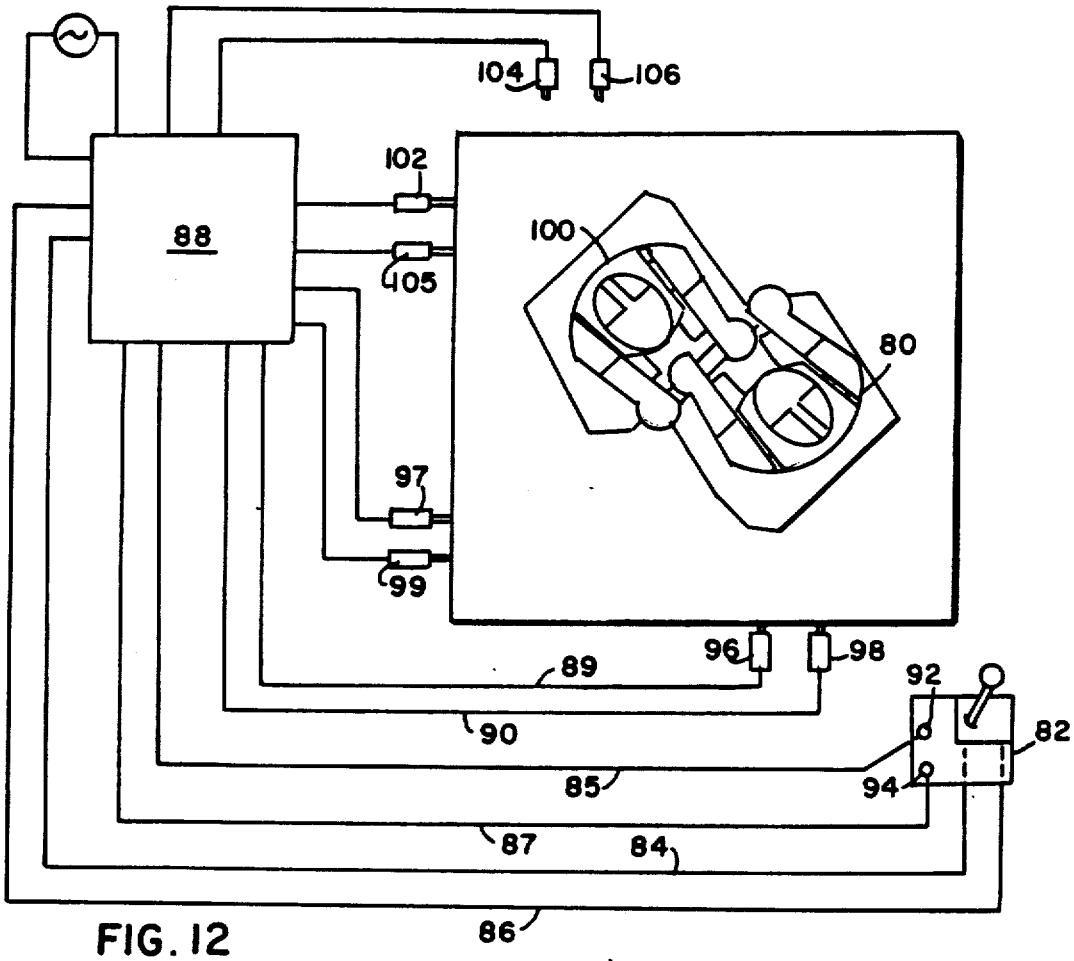
FIG. 12 is a schematic plan view of another electrically operated boxing game embodiment of the present invention.

A third embodiment of the game is shown in FIG. 12 and resembles the embodiment shown in FIG. 7, except that the boxer 80, instead of being directly manually controlled by a player, is indirectly controlled e.g. by a joy stick 82 as shown. Thus joy stick 82 sends signals via conductors 84 and 86 to a computer 88, which monitors this movement information, while sending signals to x-axis and y-axis pair of motors 97 and 99, to control the movements of boxer 80 along the x and y axes, as indicated in FIG. 12, with reference to FIGS. 3, 4 and 5. Push buttons 92 and 94 are connected via conductors 85 and 87, to computer 88 and thence from the computer via conductors 89 and 90 to solenoids 96 and 98, as shown in FIG. 12. Thus the computer 88 monitors the movements of the push buttons 92 and 94, while sending corresponding signals to the solenoids 96 and 98, to activate the punch movements of left and right arms of the player's boxer 80, as shown in FIG. 12. The computer's boxer 100 is also controlled by the computer 88 through its x-axis and y-axis pair of motors 102 and 105 and arm swinging solenoids 104 and 106, as previously discussed with respect to FIG. 7. Head knock-ups or KO's of the boxers 80 and 100 are monitored by conductors (not shown) from said boxers to the computer 88 in the manner discussed above with respect to FIGS. 7 and 11.

In operation, the player indirectly activates and maneuvers his boxer 80 by joy stick 82 (and x and y axes pair of motors 96 and 98) and solenoid buttons 92 and 94 as discussed with respect to FIG. 2. As indicated above, the joy stick and push buttons and thus the boxer 80's movements and punches are monitored by the computer 88, which quickly sends responsive signals to its x-axis and y-axis motors 102 and 105 to counter-position its boxer 100 and then operates the boxer's arms through solenoids 104 and 106, attempting to score a K.O. on the chin or head of the boxer 80, as discussed above with respect to FIG. 7.

Figure 13:
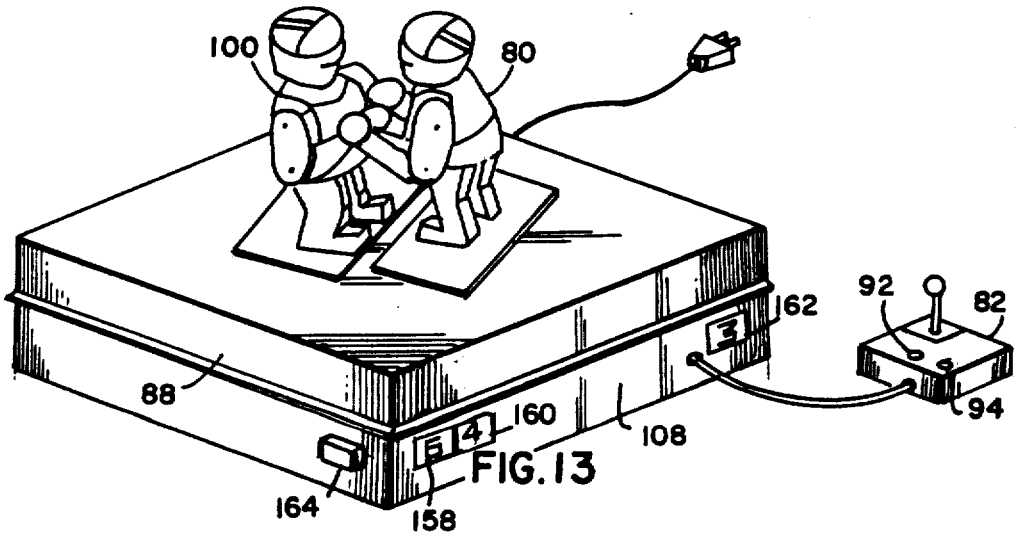
FIG. 13 is a perspective view of the invention embodiment shown in FIG. 12.

The above wires, cables, pulleys, x-y axes motors, solenoids, computer, head sensors and software and the like are all compactly housed in computer housing 108, as shown in FIG. 13, with just the boxers 80 and 100 mounted onto their movable platforms showing above such housing, along with joy stick 82 and solenoid push buttons 92 and 94 in a compact unit. Again a human controlled boxer 80, operated by joy stick 82 and push buttons 92 and 94 can compete against a computer controlled boxer 100 per FIGS. 12 and 13, according to the present invention. Also display windows 158, 160 and 162 can indicate points scored by boxers 100 and 90 and the round number, while push button 164 serves to start and restart the computer 88 and its boxer 100, as shown or indicated in FIG. 13.

As indicated above in the embodiments of the FIGS. 7 and 12, not only the body movements but the arm swings of the player's boxer can be monitored by the computer, so that the computer can quickly send responsive, evasive body motion and counter-punch signals to its boxer, making the computer's boxer more difficult to hit and more deadly of punch, as indicated in FIGS. 7 and 12, respectively. Digital signals are sent from the player's boxer controls (e.g. handle 60 and arm swing push button 62 and 64 in FIG. 7 or joy stick 82 and push buttons 92 and 94 in FIG. 12) to the respective computer (which activates by electric signals, body movements and arm swings of the player's boxer in the embodiment of FIG. 12), which monitors the body movements and arm swings of the player's boxer in the respective embodiments shown in FIGS. 7 and 12 and nearly at the same time, directs the respective computer's boxer in counter body movements and counter-punches as discussed above.

Figure 14:
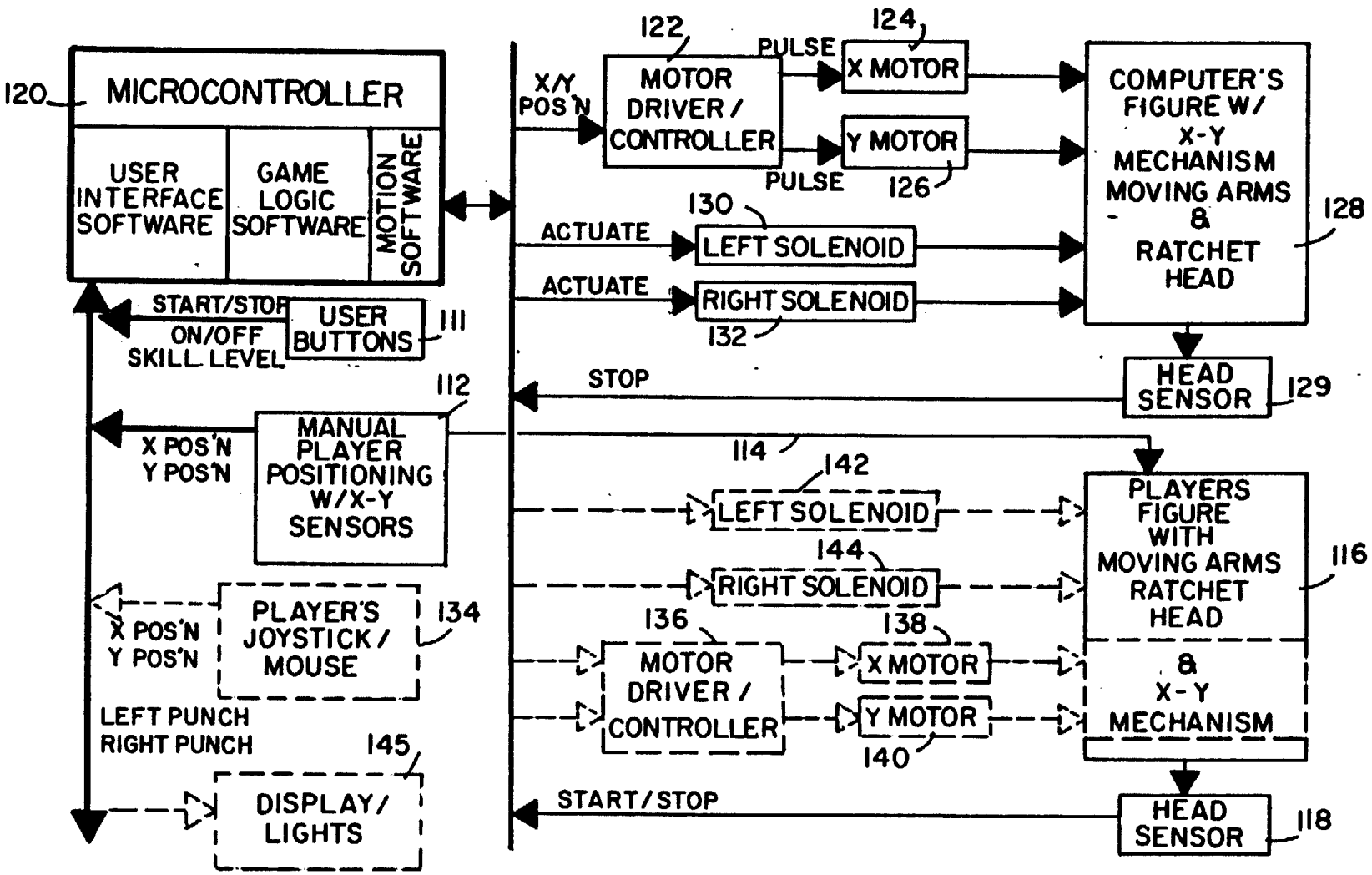
FIG. 14 is a flow chart related to the invention embodiments e.g. shown in FIGS. 2, 7 & 8 and 12 & 13.

Turning now to the flow chart of FIG. 14, one sees a schematic of all three embodiments of the invention, e.g. of FIGS. 2, 7 & 8 and 12 & 13. Thus manual user (player) 112, via contact (or arm) 114, directly moves and operates the boxer 116 with head sensor 118, as shown in FIG. 11 and described above with respect to FIG. 7. The boxer 116 has a mouse ball, track ball or other x-y axes sensor thereunder as indicated in box 112, which signals the micro-controller or computer 120 of the location of the boxer 116 as described above. The computer 120 with its responsive software sends signals to motor-driver controller 122 and in turn to x-axis motor 124 and y-axis motor 126, to guide the boxer 128, with head sensor 129, in boxing counter-movements. The computer 120 also sends signals to left solenoid 130 and the right solenoid 132, to direct the swinging of the arms of the boxer 128 at the head of the opposing boxer 116, as described above with respect to FIG. 7.

Thus the computer 120 senses the movement of the manually moved boxer 116 and quickly responds with counter-moves of its boxer 128 and attempts to knock the head of boxer 116 upwardly, activating the head sensor 118, which signals the computer to stop the action of its boxer 128 until the head of its opponent can be reset as described above.

The same is true when the computer boxer's head 128 is knocked upwardly, its head sensor 129 likewise signals the computer to stop the action until the head of its boxer 128 can likewise be reset. Play resumes when the computer 120 is reactivated by pressing start button 111.

Alternatively a joy stick or mouse 134 sends signals through computer 120 (which monitors same) and then such signals are directed to motor-driver controller 136, x-axis motor 138 and y-axis motor 140 to the boxer 116, to maneuver it as described with respect to FIG. 12. The joy stick buttons 134 also send signals to the left solenoid 142 and right solenoid 144, which in turn, swing the arms of the boxer 116 (said arms not shown), as described above with respect to FIG. 12.

The computer 120 monitors the signals of the joy stick or mouse 134 that are directed to the x-axis motor 138 and the y-axis motor 140 and thus can respond to the movements of the boxer 116, by directing its boxer 128 in counter-movements as described above. Similarly, the computer 120 can monitor the signals (from the push buttons at the joy stick 134) to the left solenoid 142 and right solenoid 144 as well as signals sent to the boxer 116, to direct counter-punch movements via its left solenoid 130 and right solenoid 132 to its boxer 128, as previously described with respect to FIG. 12.

Any of the computer-operated games embodying the invention can have a variable skill level to be set by the player e.g. by operating skill-level push button 111 shown in FIG. 14. The computer can vary the skill of its boxer's movements and punches by using different logic for different levels, e.g. by employing random movements and random punching for a percentage of the time, which increases with decreasing skill level.

Additionally the game of the invention can have a display or lights 145 which indicate, for example, the number of solid hits to the head of the opposing boxer, the skill level mode in which the boxing game of the invention is set, the round number of the bout, the time left in the round, the scoring by rounds or by points and the like.

In summary, in the embodiment of the invention shown in FIG. 2, two players compete with opposing boxers by indirect electric controls and no computer. In the embodiment shown in FIGS. 7 through 10, a player with direct manual controls competes against a boxer guided by a computer, which senses the opponents moves and directs counter-moves. In the embodiments shown in FIGS. 12 and 13, a player guides his boxer by a joy stick, mouse or other control against a computer which senses the moves of the joy stick and guides its boxer in counter-moves. In preferred embodiments of the invention e.g shown in FIGS. 7 & 8 and 12 & 13, the computer can sense the body movements and arm swings of the player's boxer and direct its boxer in counter-moves, evasive motions and counter-punches as described above. Alternatively within the scope of the invention, the circuits can be configured so that the computer senses the body movements of the player's boxer only and not the arm swings thereof as desired.

Various figures or dolls of most any form can be used as boxers in the game of the present invention, each figure to have two movable arms and a body component which can sense or react when the other figure's fist has sufficiently contacted it. As described above, the head can be elevated upon a square hit by the opponent's fist. However, other contact points can be the nose of the figure, which could e.g. retract or the body of the figure, which could suffer a partial or full knock-down or other reactive means to a square punch from the opposing boxer.

Desirable is a housing which resembles a boxing ring on the top surface and has sufficient space thereunder to enclose all of the game components, except the boxers mounted thereon.

Desirably, each boxer is movably mounted on a support member or platform capable of movement on the x and y axes. In addition to manual means e.g. as shown in FIGS. 1 and 6, the present invention includes x-y axes motors connected to a mechanism for transferring the motor's motions to x-y axes motion, such x-y axes mechanisms are known and include:

(a) lead-screw driven axes with one axis supporting the other, (b) rack-and-pinion driven axes, (c) an arrangement of cables, rods and pulleys, and (d) block and tackle cable-driven axes.

In electrically signaling the x-y axes motors, the joy stick or electronic mouse, keyboard, track ball or radio frequency controller and the like, or other means is used to transmit the desired position and punching directly to the motor and solenoids or in the computer models, to the computer which can control the body movements of the player's figure in addition to that of its own boxer.

The invention also includes sensors to read the x-y axes positions of the players platform by way of a standard computer mouse, track ball, and the like as described above. However in the computerized version shown in FIGS. 7 and 8, where the computer monitors the joy stick movements, such mouse or track ball is not required.

Solenoids or other actuators are employed to move the arms of the electrically controlled boxers according to the invention as described above. A spring or other resilient means can be used to return the arms to their rest position when the solenoid is not actuated.

A display of various points of information is desirable but not necessary within the scope of the invention as discussed above. Further posts and ropes can be added to the boxing surface to define a boxing ring if desired.

Given the computer's ability to store prerecorded data, i.e. positions, the computer's boxer can be preprogrammed to move in a way to mimic a famous boxer's style of movement.

Further the computer's boxer can be made with robot features, while the player's boxer can have human features.

Finally the boxing game of the invention can be produced as an arcade version or a home-use version as desired.

What is claimed is:

1. In a boxing game, the combination of two opposed doll boxers mounted on a support surface, each said boxer having foldable and extendable arms, electric means for controlling the body movements of at least one boxer and the arm movements of said one boxer against the other boxer, said electric means including an X-axis motor and a Y-axis motor for providing said body movements of said one boxer, manual controls connected to and operative upon said X-axis and said Y-axis motors, for controlling boxer body movement in a plane including said X-axis and said Y-axis and actuator means for controlling each arm extension and retraction of said one boxer..

2. The boxing game of claim 1, wherein the manual electric controls are selected from the group consisting of a joy stick, an electronic mouse, a track ball and a radio frequency controller.

3. The boxing game of claim 1, wherein said actuator means includes a button electrically connected to a solenoid assembly for separate movement of each boxer's arm.

4. The boxing game of claim 1, wherein a first boxer is operated by direct manual control and the second boxer is operated by a computer responsive to the movements of the first boxer.

5. The boxing game of claim 4, wherein the first boxer is connected to a handle for manual body movement thereof, which handle has left and right resiliently mounted push buttons thereon, which connect to the arms of the first boxer, which buttons separately activate said arms in punching movements, in response to the separate pressing and releasing of such buttons.

6. The boxing game of claim 5, wherein an X-Y motion sensor is electrically connected between said control means and said computer for monitoring the body movements of said first boxer, so that said computer can operate said second boxer with opposing body counter-moves.

7. The boxing game of claim 6, wherein said x-y axes sensor is an electronic mouse or track ball, mounted to said support surface to contact a component of said first boxer, so as to be responsive relative to the body movements of said first boxer and send electric signals of such movement to said computer and said second boxer.

8. The boxing game of claim 6, wherein a left arm sensor and a right arm sensor connect respectively to said left and right push buttons and thence to said computer which can thus monitor separately, the movement of each such button and thus the left and right arms swings of said first boxer, so that said computer can operate said second boxer with responsive body counter-moves and counter-punches.

9. The boxing game of claim 6, wherein said computer operates said second boxer with opposing counter-moves, using an x-axis motor and a y-axis motor for body movement thereof and electric actuation means for separate arm movement of said second boxer.

10. The boxing game of claim 5, wherein said first boxer has as a punch-received indicator, a head which is resiliently and releasably mounted to the body thereof and which upon receiving a substantial punch, pops upwardly of said body, which first boxer also has a sensor electrically connected to said computer to monitor when said head is so popped up and when it is lowered to the body into releasable engagement therewith, so as to signal the computer and the second boxer when to cease fighting.

11. The boxing game of claim 1, wherein the first boxer is directed by manually operated electric control means and the second boxer is directed by a computer with game logic, responsive to the movements of said first boxer.

12. The boxing game of claim 11, wherein an X-Y motion sensor is electrically connected between said control means and said computer for monitoring the body movements of said first boxer, so that said computer can operate said second boxer with opposing body counter-moves.

13. The boxing game of claim 12, wherein said computer operates said second boxer with opposing counter-moves, using an x-axis motor and a y-axis motor for body movement and arm movement actuators for separate punching arm movements of said second boxer.

14. The boxing game of claim 12, including means for programming said computer to operate the second boxer at varying speed and/or skill levels against said first boxer.

15. The boxing game of claim 12, wherein said manually-operated electric control means which directs said first boxer is a joy stick connected to two x-y axes motors of the first boxer, to effect body moves thereof and two push buttons are the actuator means for controlling the separate punching movements of the arms of said first boxer, with each button electrically connected separately to a solenoid assembly and thence to said arms for separate punching movement control.

16. The boxing game of claim 15, wherein said computer also electrically connects to the solenoid assemblies of said first boxer to monitor the signals sent to the arms of the first boxer, so that the computer can quickly send responsive, evasive and counter-punch signals to the second boxer, making such latter boxer more difficult to hit and more deadly of punch.

17. The boxing game of claim 16, in which the joy stick is connected to said computer and the computer is connected in turn to x-y axes motors of the first boxer, so that the computer monitors and operates same and wherein the push buttons of said joy stick are connected to said computer which is connected in turn to the solenoids for the first boxer, to monitor and activate the arms thereof, so that the computer can operate said second boxer with responsive counter body moves and counter-punches.

18. The boxing game of claim 15, wherein two boxers are mounted on two platforms, which are each movable on x and y axes over a base housing said computer, one boxer operated by a joy stick with two arm control buttons thereon, the second boxer being operated by the computer, in which motors, solenoids, sensors and software are all h used within said housing with only the boxers appearing on said housing and with said joy stick and button assembly also appearing outside said housing.

19. The boxing game of claim 18, having a display which indicates skill level mode, the number of solid hits to the head of each of the boxers or knock-downs, the number of the boxing round and the time left in such round.

20. The boxing game of claim 12, wherein the manual electric controls are selected from the group consisting of a joy stick, an electronic mouse, a track ball and a radio frequency controller.

* * * * *